United States Patent [19]

Hustad et al.

[11] Patent Number: 5,077,064

[45] Date of Patent: Dec. 31, 1991

[54] EASY-OPEN RECLOSEABLE PEGGABLE PACKAGE

[75] Inventors: Gerald O. Hustad, McFarland; Brian P. Lawless, Madison; Todd S. Marnocha, Sun Prairie, all of Wis.

[73] Assignee: Oscar Mayer Foods Corporation, Madison, Wis.

[21] Appl. No.: 504,470

[22] Filed: Apr. 4, 1990

[51] Int. Cl.[5] ..... B65D 85/00

[52] U.S. Cl. ..... 426/106; 383/5; 383/61; 383/63; 383/65; 426/122; 426/123; 426/129

[58] Field of Search ..... 426/122, 123, 129, 130, 426/106; 206/610, 632; 383/61, 63, 65, 5, 93

[56] References Cited

U.S. PATENT DOCUMENTS

| | | | |
|---|---|---|---|
| 3,371,848 | 3/1968 | Ward et al. | 426/122 |
| 3,462,069 | 8/1969 | Suominen | 383/10 |
| 3,502,486 | 3/1970 | Lundquist | 190/1 |
| 3,833,742 | 9/1974 | Wetmore et al. | 426/129 |
| 3,873,735 | 3/1975 | Chalin et al. | 426/87 |
| 4,000,768 | 1/1977 | Siegel | 150/3 |
| 4,246,288 | 1/1981 | Sanborn, Jr. | 426/122 |
| 4,290,467 | 9/1981 | Schmidt | 150/3 |
| 4,437,293 | 3/1984 | Sanborn, Jr. | 53/412 |
| 4,682,366 | 7/1987 | Ausnit et al. | 383/65 |
| 4,782,951 | 11/1988 | Griesbach et al. | 206/484 |
| 4,807,300 | 2/1989 | Ausnit et al. | 383/65 |
| 4,823,961 | 4/1989 | Griesbach et al. | 206/632 |
| 4,846,586 | 7/1989 | Bruno | 383/9 |
| 4,923,309 | 5/1990 | Van Erden | 206/632 |

*Primary Examiner*—Donald E. Czaja
*Assistant Examiner*—Anthony Weier
*Attorney, Agent, or Firm*—Lockwood, Alex, Fitzgibbon & Cummings

[57] ABSTRACT

A recloseable, peggable package wherein the enclosed product is packaged between first and second package panels includes two package extensions and a recloseable seal strip interior of the package extensions. The package panels are hermetically sealed around their periphery and further sealed to the recloseable seal strip exterior of the hermetic seal. The first and second package panel extensions are sealed exterior of the recloseable seal strip and the extensions contain at least one opening extending therethrough which enables the package to be vertically displayed on a display member.

29 Claims, 2 Drawing Sheets

10
12
14
16
17
18
19
20
21
22
26
27
28
29
30
32
34
36a
36b
38
40a
40b
41a
41b
42
44
46
48
50
51
52
54
55
56
57
58
59
60
62
64
106
28'
29'
36a'
36b'
56'
57'
64'

EASY-OPEN RECLOSEABLE PEGGABLE PACKAGE

BACKGROUND AND SUMMARY OF THE PRESENT INVENTION

The present invention relates generally to recloseable packages for hermetically sealing consumable products between generally opposing package side panels, and more particularly to recloseable packages for food products and the like in which the package has an exterior extension to which a recloseable seal is attached and which extension contains one or more pegboard hook openings to accommodate a hook member for display of the package.

Certain processed meats and/or food products sold to consumers are sold in packages in which the processed meats or food products are mounted on a backing board. The freshness of these food products such as bacon, sliced luncheon meats, cheeses and the like contained within these packages depends upon the extent to which the package is vacuum packed or gas flushed and subsequently hermetically sealed. Often, the purchaser does not use the food products contained within such packages at once, but rather uses them over an extended period of time. When the initial hermetic seal of the package has been breached during opening of the package, a portion or portions of the package are often removed. In such instances, the package cannot be effectively resealed in a manner to preserve the freshness of the food products stored within. The purchaser must often repack the food products in a different suitably recloseable container. Additionally, many packages have the package seal located close to the edge(s) of the package. From a product marketing standpoint, such packages cannot be displayed on a vertical product display, but rather, must be displayed horizontally. Accordingly, a need exists for an improved food product package of the type having a recloseable seal and which can be easily displayed in a vertical setting.

The improved packages of the present invention provide significant advantages in that a hermetic seal extends around the entire periphery of the product interior of the recloseable seal so that the package is liquid tight and suitably retains within the package, fluids of the products contained therein, including water, juices, oils and the like, while the package recloseable seal is adhered to extensions of the package panels so that the package can be opened and closed repeatedly to remove portions of the package contents without destroying the integrity of the package. Pegboard holes extending through the recloseable seal elements allow the package to be displayed vertically. A "zipper" seal consisting of interengaging components such as rib and groove fastener elements is the preferred recloseable seal means.

The hermetic seal disposed on the package panels around the periphery of the product has an easy open or "peel" seal portion located adjacent to the product and interior of the recloseable seal. The recloseable seal is opened with digital pull-apart forces which are also used to open the peel seal. The peripheral hermetic seal can maintain a vacuum, pressurized and/or gas-flushed environment within the package. The peel seal area of the hermetic seal will by formed by effecting a face-to-face seal between a plastic film and the product backing board around the periphery of the product with the strength of the seal permitting separation without destruction or tearing of the plastic film.

The recloseable seal of the packages of this invention are attached to confronting faces of extensions of the packaging film. The interengaging recloseable seal fastener elements are adhered directly to the opposing package film panels. The two interengaging fastener elements are firmly anchored to the opposing package panels and are permanently sealed at the opposite ends thereof, which decreases the possibility that the package panels may tear or separate when the hermetic seal is opened.

The interengaging fastener elements may also have vertical extensions which extend at least partially with the package panel extensions. The fastener elements and the package panels adhered thereto may have openings in them to accommodate pegboard hooks or other display hardware so that the package can be vertically displayed. A permanent seal disposed exterior of the recloseable seal elements may provide the package with a tamper-proof feature.

Accordingly, it is a general object of the present invention to provide an improved recloseable package for use with products which has a first recloseable seal disposed proximate to an access edge of the package, and a second hermetic peel seal peripherally adjacent to the product and interior of the recloseable seal.

Another object of the present invention is to provide a recloseable package for food products and the like having a recloseable seal disposed near an opening of the package and attached to a vertical extension of the package, a hermetic seal having a peelable seal area adjacent to and interior of the recloseable seal, and a permanent seal at the opening of the package, exterior of the recloseable seal.

Yet another object of the present invention is to provide an improved product package having a peel seal and a recloseable seal, wherein the recloseable seal elements are attached to extensions of the opposing package panels, the package extensions having means for supporting the package on a vertical display.

Still another object of the present invention is to provide an improved food product package having a peelable hermetic seal disposed around the periphery of the food product and interior adjacent to a recloseable seal, a recloseable seal exterior of the peelable seal, a portion of the recloseable seal having means to accommodate pegboard display hooks and a permanent seal exterior of the recloseable seal and pegboard mounting means having tamper evident means thereon.

These and other objects of the present invention will become more readily apparent from a reading of the following detailed description.

DETAILED DESCRIPTION OF THE INVENTION

Figures 1, 2, 3:
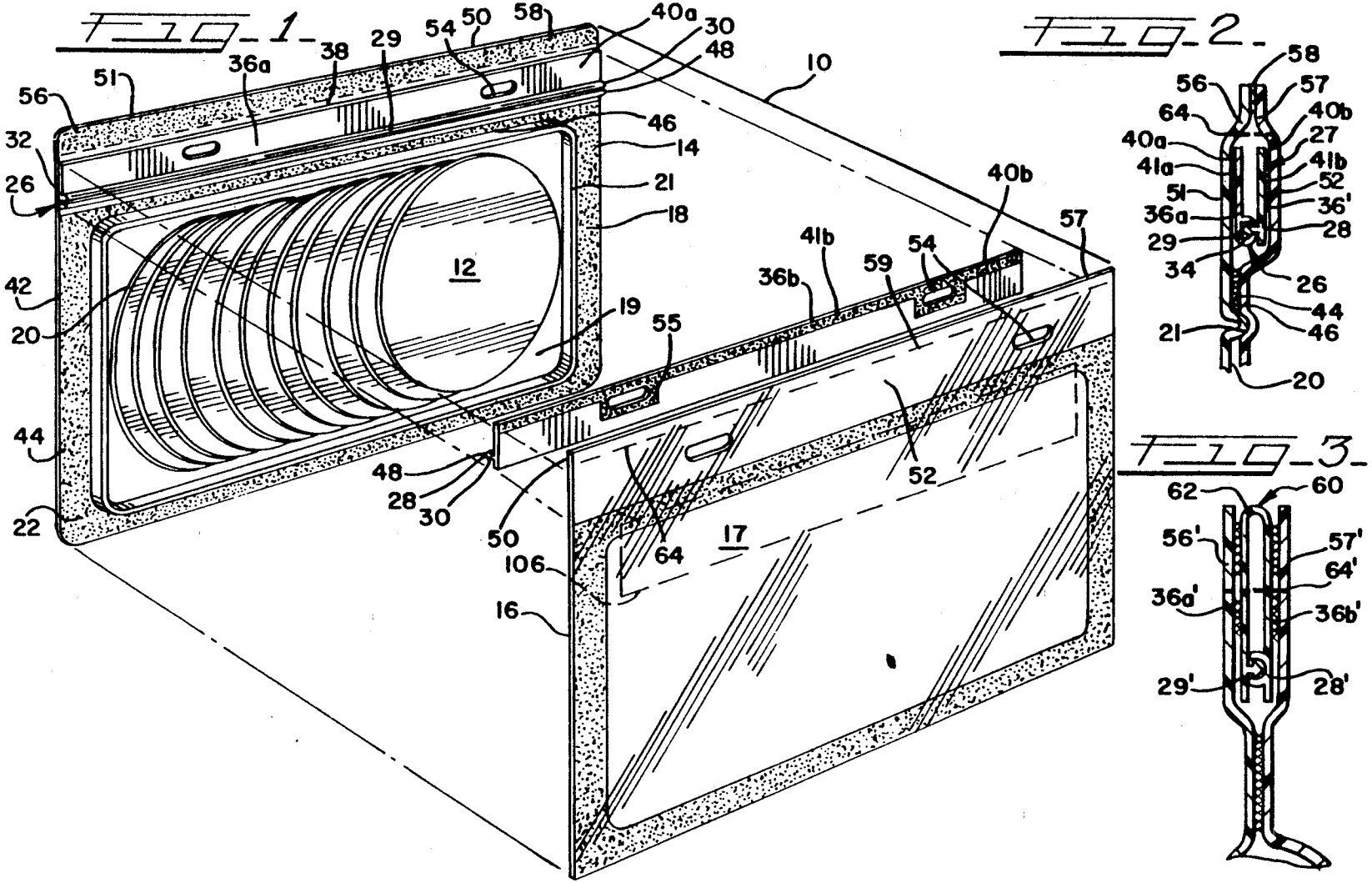
FIG. 1 is an exploded view of a package incorporating the principles of the present invention. For purposes of illustration only, the package is shown as containing vacuum-packed luncheon meats.
FIG. 2 is a cross-sectional view of the upper portion of the package of FIG. 1, taken in an assembled state.
FIG. 3 is a cross-sectional view showing an alternate construction of a package incorporating the principles of the present invention.

FIG. 1 illustrates a recloseable package 10 constructed in accordance with the principles of the present invention. The packages 10 of the present invention are particularly suitable for sealing a perishable food product, shown in FIGS. 1 and 2 as luncheon meat slices 12, between a first package panel 14 and a second package panel 16. The first and second package panels 14 and 16 which form the two sidewalls of the package 10 can be made from a variety of materials including plastic films, plastic films with heat sealable coatings, multi-layered laminates and/or co-extrusions, thermoformable materials and the like. A preferred plastic film for assembly of the packages of the present invention is one which is substantially impervious to air, oxygen and/or moisture.

When one or more of the package panels 14, 16 is formed from a multi-layered construction, it is desirable to use a thin, inner layer which is substantially impervious to air, oxygen and/or moisture in combination with an outer layer having sufficient flexibility and desirable structural characteristics so that the laminate can function as a package sidewall film. For purposes of illustration and discussion, the package panels depicted as flexible sheets will be shown as a single, heat-sealable lamina. In actual practice, each flexible package panel will likely be a co-extrusion and/or laminate of two or more layers which will provide sufficient protection to the product (e.g., oxygen and moisture barriers) and which can form a hermetic, and if desired, peelable seal at the inner surfaces. As is known in the art, multi-layered films comprised of copolyester films or sheets, vinylidene chloride polymers or sheets such as "Saran", ethylene vinyl acetate, a Surlyn ionomer or polyethylene plastic films or sheets are suitable.

FIG. 1 illustrates a package 10 in which one package panel 14, in the form of a generally rectangular and substantially rigid, thermoformed plastic product tray or backing board 18, sometimes referred to as "bacon" board, which supports a plurality of luncheon meat slices 12 which are enclosed on the backing board by an opposing package panel 16, illustrated as a flexible film sheet 17. Much like the laminated film described above, the backing board 18 is also preferably constructed from a material which is substantially impervious to air, oxygen and/or moisture. In this regard, a somewhat rigid thermoplastic sheet is used to provide a support surface 20 for the luncheon meat 12. Backing boards formed from polyvinyl chloride or Barex® with or without heat sealable coatings have been found to exhibit the preferred desired rigidity and film sealing capabilities. Paperboard may also be used as the product backing board provided that it has been previously rendered impervious to oxygen, air and/or moisture, such as by lamination to a film with the desired properties.

The luncheon meat slices 12 or the like are desirably positioned on the backing board 18 within a means for retaining the luncheon meat 12 in a packaged product area 19, illustrated as a raised portion or wall 21 of the backing board 18. Not only does the raised portion 21 retains the luncheon meat 12 within the packaged product area 19, but also it serves as a first barrier to any juices, oils, or fluids from the luncheon meat 12 within the product area 19. The raised portion 21 can be formed integrally within the backing board 18 (most easily accomplished when the backing board 18 is made of a thermoplastic material) or alternately, can be formed by attaching a separate member to the backing board 18.

As used in this invention and description thereof, the top 11 of the package is meant to refer to that segment of the package perimeter which contains the package mouth 59 or access opening. The film sheet 17 and the backing board 18 are combined by contacting each other around the luncheon meat 12 to form a peripheral margin 42 extending around the periphery of the product as positioned on the backing board 18. When a vacuum is applied to the space between the film sheet 17 and luncheon meat 12, the film sheet 17 is drawn inwardly about the luncheon meat 12 or the like to conform to the contour thereof to provide the package 10 with improved rigidity for withstanding rigorous handling during transport and retail display and the like.

When a multi-layered flexible film is used wherein the surface of the film sheet 17 which contacts the plastic backing board 18 is formed from a layer of ethylene vinyl acetate, the inherent qualities of the ethylene vinyl acetate layer provide a secure, yet peelable hermetic continuous edge seal 22 outside the board raised portion 20, which maintains a secure seal during handling and storage that can be peeled back upon the application of digital forces applied through an outer recloseable seal 26 or the like.

Referring to FIGS. 1 and 2, the package has a first, outer recloseable seal 26 illustrated as a conventional interengaging fastener assembly 27 such as a rib and groove fastener assembly. Although the interengaging fastener assembly 27 is illustrated as one that is particularly secure for the illustrated type of package 10, namely, having a length of a formed single rib element strip 28 and a similar length of a formed single groove strip 29, it will be noted that the interengaging fastener elements 28 and 29 of the recloseable seal 26 are not limited to any particular number of interengaging fastener elements. The rib 30 projects outwardly from the rib element strip 28 a sufficient distance to be securely interengaged with and held by its confronting and complementary counterparts in the groove element strip 29. The groove element strip 29 shown includes two outwardly extending walls 32 which define a channel or groove 34 therebetween. The groove 34 is of sufficient width to firmly engage the rib 30 when the confronting interengaging fastener elements 28, 29 are pressed together. Both the recloseable seal 26 and the interengaging fastener assembly 27 can take any number of various characteristics and configurations in addition to those described herein. Although the two confronting interengaging fastener elements 28, 29 are shown as separate members, the fastener elements can be extruded with the package panels.

The rear surfaces of the interengaging fastener elements 28, 29 may include attachment means in the form of flanges 36*a*, 36*b* which extend transversely to the fastener elements 28, 29. As best illustrated in FIG. 2 these flanges 36*a*, 36*b* are of a sufficient width to provide appropriate surfaces to adhere and seal both the film sheet 17 and the backing board 18 to the recloseable seal fastener elements 28, 29. When the flanges 36*a*, 36*b* are sufficiently wide, it is desirable to locate the interengaging fastener elements 28, 29 toward the bottom of the flanges so that after any tear-off strip 50 of the package 10 is removed, the uppermost portions 60 of the flanges 36a, 36b will serve as pull flanges 61 which easily enable the user to obtain easy access to the recloseable seal 26.

The flanges 36a, 36b can either be separate members as shown in FIGS. 1 and 2 which are formed apart from the rib and groove elements and subsequently attached thereto by any suitable means such as heat sealing or adhesive sealing. The flanges 36a, 36b can also be integrally formed with their respective fastener elements 28, 29 as shown in FIG. 2. Alternatively, and as shown in FIG. 3, the flanges 36a', 36b' can be part of a separately recloseable seal flange web assembly 60, in which the respective fastener elements 28', 29' are integrally joined to an interior web 62. Where such a construction is used, the central portion of the web assembly 60, will cooperate with the free ends 56', 57' of the package to form a package tear strip 50' proximate to the line of weakening 64' as described more fully below.

One flange 36b of the interengaging fastener elements 28, 29 is disposed so that a longitudinal surface 40b of the flange 36b is opposite and adjacent to the backing board 18. Whether the product containing package panel is a rigid thermoformed backing board 18 or a semi-rigid film 84, the interengaging fastener assembly 27 may be attached to the same by adhering the fastener element flange longitudinal surface 40b to its access edge 38. This may be accomplished by any appropriate means such as a suitable adhesive or, in instances where the product containing package panel 14 is a rigid thermoplastic material, the fastener assembly 27 may be adhered to the backing board 18 by heat sealing, ultrasonic welding or the like. The interengaging fastener assembly 27 is preferably of the same length as the backing board 18 and the interengaging fastener elements 28, 29 are attached together at their opposite ends 48 so that the fastener material is not wasted in the trimming of the package 10 and so that it does not interfere with the peripheral hermetic seal 44 of the package.

The interengaging fastener assembly 27 may be fitted onto the product carrying package panel 14 and the ends30 thereof are attached together, the product 12 is positioned thereon within the upraised portion 21 thereof to form a product-panel assembly. The opposing film sheet 17 is brought into contact with the product panel 16, and a vacuum is applied therebetween. A second, hermetic seal 44 is formed around the periphery of the product and interior of the first, outer recloseable seal 26. The opposing film sheet 17 is then permanently adhered to the recloseable seal 26 along the longitudinal surface 40a of the fastener element sealing flanges 36a, by heat sealing, ultrasonic welding, by adhesive or by any other suitable means. Any air present between the two panels 14, 16 when the product is inserted, can be evacuated and/or product 12 gas-flushed if desired.

Significantly, the package panels 14 and 16 each include an integral, vertical package extension 51, 52 which extends exterior of the recloseable seal 26 near the top of the package and has a sufficient extent to accommodate a means for supporting the package 10 on a vertical display, shown as openings 54. The openings 54 are configured to receive a pegboard display element and are preferably positioned within the recloseable seal fastener element flange portions 36a, 36b of the extensions 51, 52. The permanent seals 41a, 41b which attach the flanges 36a, 36b to their respective package panels 16 and 17 preferably circumferentially extends around the perimeter 55 of the openings 54 to ensure the integrity of the package extensions 51, 52.

The free ends 56, 57 of the extensions 51, 52 are secured by suitable generally permanent bonding means shown as a permanent package mouth seal 58 disposal exterior of the recloseable seal 26 and the package mouth 59. A tamper evident component of the package is further defined by a line of weakening 64, shown as perforations, extending longitudinally within the extensions 51, 52 generally adjacent to the recloseable seal 26. The line of weakening 64 can be administered in any suitable manner such as by perforations or scoring. The free ends 56, 57 of the extensions 51, 52 thereby serve as a package tear strip 50 which will indicate prior opening of the package 10. If desired, an additional line of weakening may be provided in order to facilitate opening of the package by grasping the tear off strip 50 in one hand and the package body in the other hand. By this structure, access which permits opening of the recloseable seal fastener elements 28, 29 is possible only upon severance or ripping of the tamper-evident strip.

Figure 4:
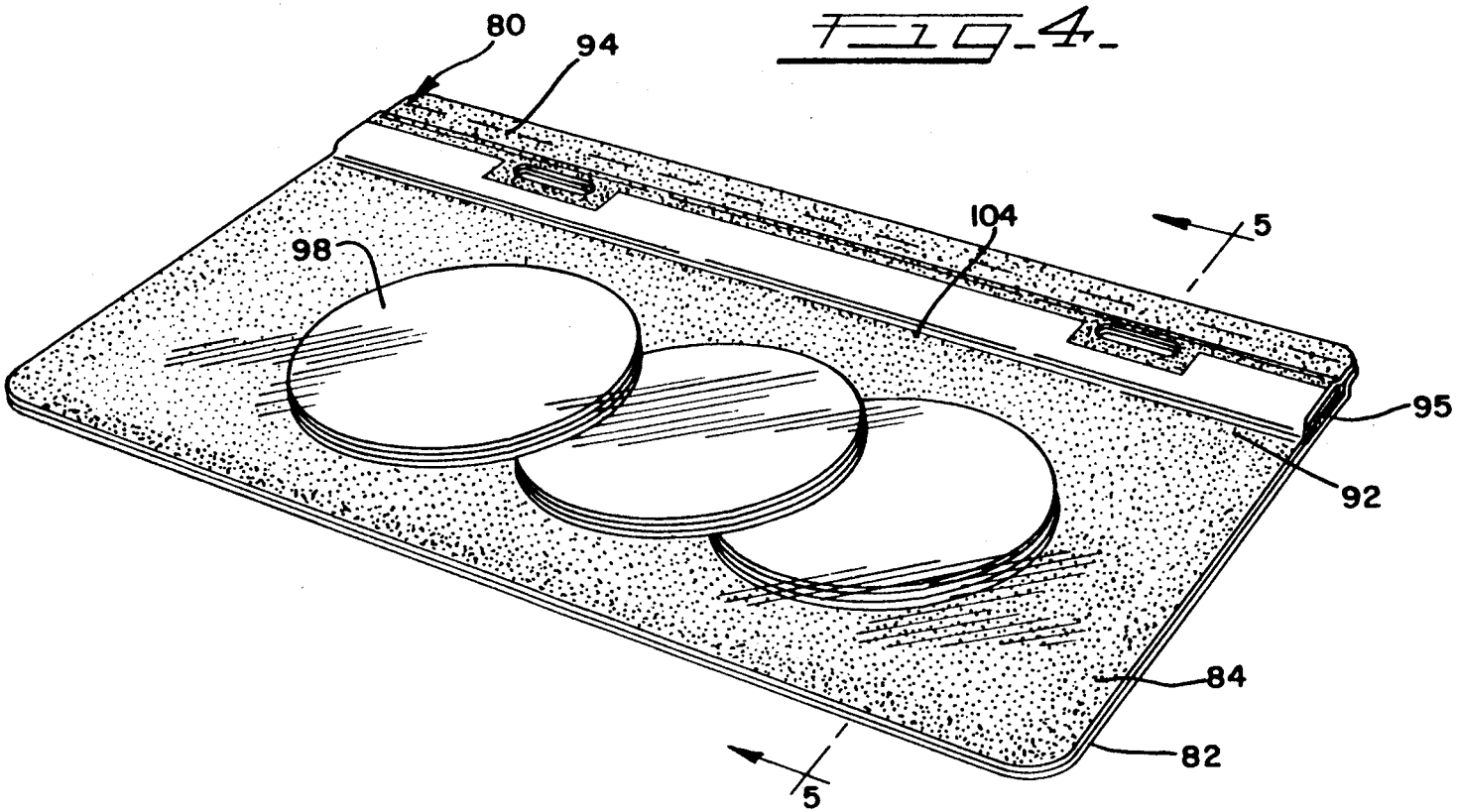
FIG. 4 is a perspective view of an alternate embodiment of a package incorporating the principles of the present invention. For purposes of illustration only, the package is shown as containing vacuum-packed luncheon meats.

The embodiments illustrated in FIGS. 1 and 4 are advantageous because they are especially suitable to being formed, filled and sealed on existing machinery, requiring minimal modifications to the packaging machery and/or material used in forming packages having reclosure strips. In addition, these embodiments provide easily understood tampering indicators while requiring no other, separate tamper-evident component, inasmuch as the package extensions perform the tamper-evident feature.

Figure 5:
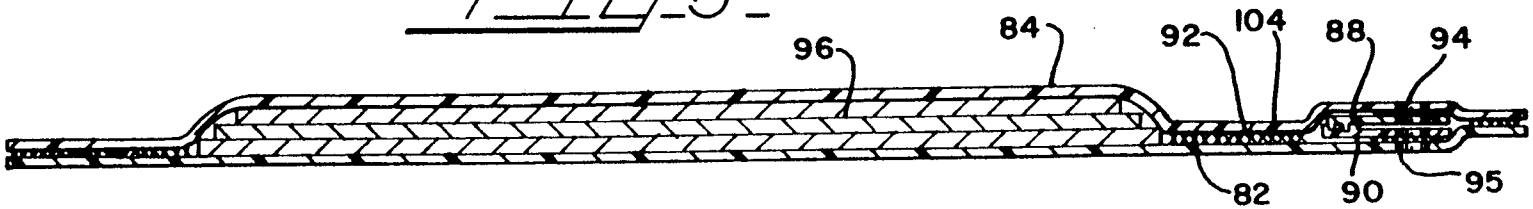
FIG. 5 is a cross-sectional view taken along line 5—5 of FIG. 4.

As best seen in FIG. 1, it is desirable to make a portion of the hermetic seal 44 which is interior of and adjacent to the recloseable seal 26 a peelable seal 46 to allow the purchaser simple and easy access to the product 12. The hermetic seal 44 may be entirely of a peelable nature with the hermetic seal portion thereof having a stronger bond effected between the film and the backing board peripheral margin 42 than in the peelable seal portion 46 interior of the recloseable seal 26 so that the hermetic seal 44 is, for all intents and purposes, non-peelable. The hermetic seal 44 provides a second barrier to product liquids and cooperates with the product containment means 21 to substantially prevent the dispersion of product liquids into the recloseable seal. In any event, because the hermetic seal 44 is positioned interior of the recloseable seal 26, the likelihood of "leakers", i.e., packages wherein air enters and the product juices or oils escape from the product area 16 and enter the recloseable seal area, is greatly diminished Another embodiment of a recloseable food product package 80 incorporating the principles of the present invention is shown in FIGS. 4 and 5. The basic structure of this alternate embodiment, such as the package panel extensions 94, 95, the recloseable seal interengaging fastener elements 88, 90 and the inner peripheral peel seal 92 is the same as that described for the first embodiment. However, in this illustrated embodiment, the package 80 utilizes two flexible sheets of package film 82, 84 as the package components rather than a thermoformed backing board and a covering film. In this embodiment, the package panel 84 shown overlying the luncheon meat can be a semi-rigid film which is capable of being formed to provide a product containing cavity 96 to accommodate a preselected amount of luncheon meat 98. In this alternate construction, the second or opposing package panel 82 is contacted and bonded to the package panel 84 to form the package 80.

After the luncheon meat 98 is deposited in the second panel product cavity 96, the first package panel 82 is then contacted to the second package panel 84 around the perimeter 100 of the product cavity 96 to form a hermetic seal 92 with a peelable seal area 104 interior of the recloseable seal interengaging fastener elements 88, 90.

During production of packages of the present invention, a continuous strip of the recloseable seal interengaged fastener elements 28, 29 may be fed and applied to the access edge 38 of a continuous length of the product carrying package panel 14 and sealed thereto to adhere the recloseable seal continuous strip to the package panel 14. The continuous strip of interengaged fastener elements 28, 29 are preferably trimmed even with the edges of the package panel 14 and are attached together at their ends 30 to form the package mouth. Accordingly, there is no wasting of the recloseable seal material. An individual product carrying package panel 14 may then be dimensioned and cut from the continuous length and transferred to a product application area. A preselected amount of luncheon meat 12 is then deposited thereon within the previously formed upraised portion 21 to form a product-panel assembly, which is subsequently transferred to a packaging station where the opposing film sheet 17 may be fed from supply rolls into a position opposite the product support surface 20 of the product-backing board assembly and into contact therewith at a peripheral margin 42 extending around the product-backing board assembly. The film sheet 17 is adhered to the recloseable seal fastener element flanges 36*a*, 36*b* and is further bonded to the product-panel assembly at the peripheral margin 42 thereof to form the package hermetic seal 44.

Subsequently, the permanent mouth seal 58 and the line of weakening 64 may be applied and the package display openings 54 formed in the package extensions 51, 52. Either before or after forming the package openings 54, a package label 106 (shown in phantom) or other package graphics may be applied to the package panels in a conventional manner.

When it is desired to open a finished package, the user grips the package extension permanent mouth seal 58 and tears it off along the line of weakening 64 to gain access to the recloseable seal 26. The two pull flanges 61*a*, 61*b* of the package extensions 51, 52 are gripped and the user applies digital pull apart forces to open the recloseable seal 26 and the peel seal portion 46 of the hermetic seal 44 The recloseable seal 26 will separate and open, thereby allowing access to the inner peelable seal 46. The recloseable seal fastener elements 28, 29 will open to form a package mouth and because the recloseable seal 26 is adhered to the package panels 14 and 16 and attached at its ends 30, the likelihood of destruction of the integrity of the package 10 is greatly diminished.

It will be seen that while certain embodiments of the present invention have been shown and described, it will be obvious to those skilled in the art that changes and modifications may be made therein without departing from the true spirit of the scope of the invention.

I claim:

1. A recloseable package for hermetically sealing a product between two opposing package panels, comprising in combination:

a first package panel for receiving a preselected amount of a product positioned thereon in a predesignated first package panel product area, the first package panel including an integral extension portion;

means for containing said preselected amount of product within said predesignated first package panel product area, the product containment means being disposed in and integrally formed on said first package panel, said product containment means including a raised wall of said first package panel;

continuous recloseable fastener means attached to the integral extension portion of the first package panel, the continuous recloseable fastener means being disposed proximate to an access edge of said first package panel, said continuous fastener means including opposed interengaging fastener elements being disposed generally parallel to the access edge of said first package panel and being further disposed near a mouth portion of said package, the opposed interengaging fastener elements being further attached to each other at longitudinal ends thereof to define the mouth portion of said package;

a second package panel having an integral extension portion, the second package panel contacting said first package panel around a peripheral margin of said first package panel surrounding the first package panel product area to form a package, said second package panel further being attached to said continuous recloseable fastener means so as to form a recloseable package seal, the recloseable package seal being disposed near said mouth portion of said package, said first and second package panels further being bonded together to form a hermetic package seal, the hermetic package seal extending around substantially the entire periphery of said product containment means, said hermetic package seal including a peelable portion, said peelable seal portion being disposed on inner surfaces of said first and second package panels at a location interior of said interengaging fastener elements and exterior of said package panel product area;

said first and second package panel respective first and second package integral extension portions being disposed on the package at a location exterior of said interengaging fastener elements, the first and second package integral extension portions being disposed generally opposite to each other, said first and second package integral extensions having means for supporting said package on a display in a vertical display position; and said product containment means providing a first barrier to liquids associated with said product and said hermetic package seal providing a second barrier to said product liquids, said product containment means and said hermetic package seal cooperating together to substantially prevent the dispersion of said product liquids from said product into said recloseable seal.

2. The package of claim 1, wherein each of said interengaging fastener elements includes a sealing flange, said first and second package integral extension portions being attached to the respective sealing flanges.

3. The package of claim 1, wherein said first and second package integral extension portions contact each other at longitudinal confronting surfaces thereof and are bonded to each other at the longitudinal confronting surfaces to form a package mouth seal, said first and second package integral extension portions further including a line of weakening disposed exterior of said interengaging fastener elements and interior of the package mouth seal, said line of weakening defining a tear-off strip of said package.

4. The package of claim 2, wherein said package display supporting means includes at least one opening passing through said first and second package extensions and said interengaging fastener element sealing flanges, the at least one opening being adapted to receive a display member therethrough.

5. The package of claim 4, wherein said interengaging fastener element sealing flanges are sealed to said first and second package integral extension portions around said openings.

6. The package of claim 1, wherein said first package panel is a formed thermoplastic and said second package panel is a multi-layered film sheet, the inner surface of the multi-layered film sheet which contacts and bonds to said first package panel being a layer of polyethylene or Surlyn ionomer film.

7. The package of claim 2, wherein said first package panel is a semi-rigid multi-layered film sheet having said product area formed therein and said second package panel is a multi-layered film sheet, the inner surface of the second package panel multi-layered film sheet being a layer of polyethylene or Surlyn ionomer film.

8. The package of claim 1, wherein said hermetic peel seal is formed by adhesive means.

9. The package of claim 1, wherein said second package panel is formed from a flexible, oxygen-impermeable multi-layered package film.

10. The package of claim 1, wherein said interengaging fastener elements include interengaging rib and groove elements.

11. The package of claim 1, wherein said first and second package integral extensions are joined together exterior of said interengaging fastener elements and exterior of said display support means and include means which indicate prior opening of the package.

12. The package of claim 1, wherein said first package panel product containment containing said product in said product area, the containment raised wall defines a product cavity.

13. The package of claim 1, wherein said package is for enclosing perishable food products.

14. The package of claim 1, wherein said first package panel has a generally rectangular shape and said second package panel is bonded to said first package panel along the periphery of three edges of said first package panel to form a generally permanent hermetic seal peripherally adjacent to the packaged product along the first package panel three edges and said second package panel is further bonded to said first package panel interior of said recloseable fastener means to form a peelable seal and said first and second package panel integral extension portions are longitudinally bonded to each other adjacent the package mouth portion to form a permanent package mouth seal, the package mouth seal being separated from said interengaging fastener elements by a line of weakening.

15. A recloseable, multi-seal package for hermetically sealing a product between two opposing package panels and for displaying said product package on a vertical display means comprising, in combination:

a first package panel which receives a preselected amount of a product thereon in a first package panel product area the first package panel product area including means for containing said product in said package product area, the product containment means including a raised wall of said first package panel defining said first package panel product area, said product containment means substantially preventing the dispersion from the product of liquids associated therewith from said first package panel product area to a package recloseable seal;

continuous recloseable fastener means attached to an extension of the first package panel proximate to an access edge of said first package panel, the continuous fastener means including opposed interengaging fastener elements being disposed generally parallel to the access edge of said first package panel and being further disposed near a mouth portion of said package, the opposed interengaging fastener elements being further attached to each other at longitudinal ends thereof to define the mouth portion of said package;

a second package panel contacting said first package panel around a peripheral margin of said first package panel surrounding said first package panel further being attached to said continuous recloseable fastener means so as to form a recloseable, package first seal near said mouth portion of said package, said first and second package panels further being bonded together to form a hermetic, package second seal substantially surrounding said product containment means and extending around substantially the entire periphery of said product containment means and said product disposed in said package panel, a portion of said hermetic seal also substantially preventing the dispersion of said product liquids from said first package panel product area to said recloseable seal, the hermetic package second seal having a peelable portion disposed between said first and second package panels at a location interior of said interengaging fastener elements and adjacent said first package product area;

each of said first and second package panels including an integral package extension portion disposed exterior of the recloseable, package second seal, the first and second package integral extension portions being disposed closely adjacent to each other and having means for supporting said package on a display in a vertical display position, whereby said hermetic, package second seal cooperates with said product containment means to substantially prevent the dispersion of product liquids from said first package panel product area to said recloseable seal or to a tamper-indicating package third seal; and said first and second package integral extension portions being contacted and permanently bonded to each other along a longitudinal extent thereof exterior of said recloseable fastener means to form the tamper-indicating package third seal, at the mouth of said package, said first and second package integral extension portions further including a line of weakening disposed exterior of said recloseable fastener means and interior of said tamper-indicating package third seal.

16. The package of claim 15, wherein each of said interengaging fastener elements includes a sealing flange, said first and second package panel integral extension portions being attached to the sealing flanges, said package integral extension portions and said interengaging fastener element sealing flanges including at least one opening adapted to receive a vertical display member.

17. The package of claim 15, wherein said first and second package panels are formed from a flexible, oxygen-impermeable multi-layered package film.

18. The package of claim 15, wherein said first package panel is a generally rigid, formed thermoplastic and said second package panel is a multi-layered film sheet.

19. The package of claim 15, wherein said first package panel is a semi-rigid formed multi-layered film sheet and said second package panel is a multi-layered film sheet.

20. The package of claim 15, wherein one of said first and second package extensions contains package identifying indicia.

21. The package of claim 15, wherein said package is for enclosing perishable food products.

22. A method of enclosing a product between two package panels, the method comprising the steps of:

providing a first package panel and a second package panel;

providing a fastener strip assembly of interengaging fastener elements;

providing a package product area in the first package panel by forming a product containment means therein in the form of a raised wall of said first package panel to retain said product in said package product area and to provide a first barrier to contain product liquids within said package product area;

attaching the interengaging fastener elements to one of said first and second package panels to define a package access end portion and first and second package extensions, the interengaging fastener elements each having a package sealing flange disposed on opposite sides of the fastener strip;

placing the product onto said first package panel within said product area product containment means in a manner such that the product does not contact the package sealing flanges of said fastener strip to form a product-backing assembly;

placing said second package panel over the product-backing assembly;

sealing said first package panel to said second package panel at a hermetic seal area around the periphery of said product on said product-backing assembly to create a package having a hermetic seal which completely encloses said product on said product-backing assembly wherein said hermetic seal area extends round substantially the entire periphery of said product containment means to provide a second barrier to substantially prevent product liquids from moving from said package product area to said interengaging fastener elements, said hermetic seal area including at least one peelable bond area generally at the access edge portion of said product backing member and interior of said interengaging fastener elements; and, forming in the package, means for supporting said package on a vertical display in the fist and second package extensions.

23. The method of claim 22, wherein said interengaging fastener elements are adhered to said first and second package panels by adhesive means.

24. The method of claim 22, further including the steps of permanently sealing a longitudinal portion of two confronting faces of said first and second package extensions and providing a line of weakening on said first and second package extensions.

25. The method of claim 22, wherein said interengaging fastener elements are adhered to said first and second package extensions by heat sealing means.

26. The method of claim 22, wherein said interengaging fastener strip assembly includes interengaging rib and groove elements.

27. The method of claim 22, further including the step of vacuum-packing said product between said first and second package panels.

28. A method useful for enclosing a product between a first and second package panel to provide a generally flexible multi-seal package having a product enclosing portion, a vertical display portion and multiple package seal portions so as to form distinct package first, second and third seals the first and second package panels being readily separable at the recloseable package second seal when access to the product is desired, the method comprising the steps of:

providing said recloseable package second seal by applying a continuous recloseable seal member adjacent and generally parallel to an access edge of the first and second package panels, the recloseable seal member including a pair of interengaging fastener elements, each element having a package sealing flange, the continuous recloseable seal member being applied to said first and second package panels along the respective sealing flange of the interengaging fastener elements, said continuous recloseable seal member defining first and second package extensions on said first and second package panels;

designating a product location on one of said first and second package panels to define a product enclosing portion by forming a product containment member including a raised wall in said one of said first and second package panels, the raised wall extending outwardly from said one of said first and second package panels and further extending around and defining the product enclosing portion of said one of first and second package panels;

drawing said first and second package panel together to bring said first and second package panels into contact with each other around the periphery of the product enclosing portion and interior of said recloseable seal member;

bonding said first and second package panels together around substantially the entire periphery of said raised wall, whereby a package first seal which provides a peelable hermetic bond is provided proximate to said product board access edge and a generally secure, yet peelable hermetic bond is provided as to the remainder of the package;

attaching said first and second package panels to said respective package sealing flanges of said interengaging fastener elements and defining an opening portion in the first and second package panel extensions;

providing at least one package display opening through the opening portion of said first and second package panel extensions, said opening adapted to receive a package display member therein;

permanently sealing a longitudinal extent of said first and second package extensions exterior of said recloseable seal member to provide the package third seal; and providing a line of weakening on said first and second package panel extensions exterior of said recloseable seal member to give said third package seal a tamper-indicating removable portion, whereby said package hermetic first seal and said raised wall cooperate to substantially prevent the transfer of product liquids form within said raised wall to seal recloseable seal member and said tamper-indicating third package seal.

29. The recloseable, multi-seal package of claim 15, wherein said raised wall defines a product cavity formed in said first package panel.

* * * * *